US005439721A

United States Patent [19]

Pedroli et al.

[11] Patent Number: 5,439,721

[45] Date of Patent: Aug. 8, 1995

[54] LABEL FOR PACKAGED PRODUCTS

[75] Inventors: John L. Pedroli, Germantown; Larry Feldmann; Henry P. Littleton, both of Memphis; Richard L. Walton, Bartlett; James W. Littleton, Bartlett; Kelly E. Haley, Bartlett, all of Tenn.

[73] Assignee: ELR, Inc., Wilmington, Del.

[21] Appl. No.: 88,449

[22] Filed: Jul. 7, 1993

[51] Int. Cl.[6] ..... B42D 15/00; G09F 3/00

[52] U.S. Cl. ..... 428/40; 40/310; 281/2; 281/5; 283/81; 283/101; 283/109; 428/43; 428/137; 428/138; 428/192; 428/195; 428/202; 428/203; 428/220; 428/354; 428/906

[58] Field of Search ..... 428/40, 43, 131, 137, 428/138, 192, 194, 195, 202, 203, 219, 220, 354, 914, 906; 283/81, 101, 109, 116, 61, 62, 103, 105; 281/2, 5; 40/638, 630, 310, 312

[56] References Cited

U.S. PATENT DOCUMENTS

| | | | |
|---|---|---|---|
| 1,995,076 | 3/1935 | Perryman | 156/252 |
| 3,126,211 | 3/1964 | Hieken | 283/101 |
| 3,574,026 | 4/1971 | Kucheck | 156/152 |
| 4,621,837 | 11/1986 | Mack | 283/81 |
| 4,983,438 | 1/1991 | Jameson | 428/42 |
| 4,991,878 | 2/1991 | Cowan | 428/40 |
| 5,127,676 | 7/1992 | Bockairo | 283/81 |
| 5,167,752 | 12/1992 | Dowling | 156/512 |
| 5,207,746 | 5/1993 | Jones | 283/81 |

FOREIGN PATENT DOCUMENTS

| | | |
|---|---|---|
| 0382398 | 8/1990 | European Pat. Off. . |
| 0506202 | 9/1992 | European Pat. Off. . |

*Primary Examiner*—Nasser Ahmad

*Attorney, Agent, or Firm*—Bell, Seltzer, Park & Gibson

[57] ABSTRACT

A label for packaged products about which information is to be provided with the package includes a bottom layer of imprintable material having an adhesive coating on one surface thereof and indicia pre-printed on the other surface thereof, and an upper layer of clear plastic film laminated to the bottom layer at opposite end portions thereof and substantially covering the printed surface of said bottom layer, the upper layer having a window die cut therein to expose a portion of the surface of the bottom layer through the plastic film for the imprinting of additional indicia at the time of the label application.

6 Claims, 3 Drawing Sheets

LABEL FOR PACKAGED PRODUCTS

FIELD OF THE INVENTION

This invention relates to labels to be applied to packages of products and more particularly to labels having indicia pre-printed thereon, which indicia is covered and protected by a clear plastic film.

BACKGROUND OF THE INVENTION

Various and sundry products are packaged for sale to consumers in boxes, bottles and the like. In most instances, it has been the practice to apply pre-printed labels to such product packaging. Typically, such labels have an adhesive coating on the back surface thereon to adhere the label to the product package. The front surface of these labels is usually pre-printed with indicia to impart information about the product to consumers and other interested persons.

For many applications, such as pharmaceuticals, it is considered desirable to cover the printed surface of such labels with a clear plastic film. It is also desirable with some products, e.g. pharmaceuticals, to include with the product an information booklet containing considerably more information about the product than can be imprinted on the label. A label having a clear plastic film outer layer and an imprintable inner layer has been proposed and in which a pocket is provided in the label. The informational booklet is removably contained in this pocket.

While such prior labels have been successful in solving certain problems, they have deficiencies and disadvantages which have limited their adoption and use. Among these deficiencies and disadvantages is the problem of printing additional indicia on the label at or near the time of application of the labels to the packages. In many labeling operations, there is a need or requirement that additional indicia, such as specific lot numbers, expiration dates, etc., be printed on the label at or near the time of label application. However, the plastic film covering the imprintable layer of the label can not be readily imprinted. Accordingly, users of these prior labels have had to take special steps to add such indicia to the product package since it could not be printed on the label.

With the foregoing in mind, it is an object of the present invention to provide a label which overcomes the deficiencies and disadvantages of labels heretofore available.

SUMMARY OF THE INVENTION

This object is achieved by providing a label having a bottom layer of imprintable material and an upper layer of clear plastic film laminated to the bottom layer. A window is die cut in the upper layer to expose a portion of the imprintable bottom layer which can be printed, through the window, with additional indicia at or near the time of label application. The upper layer may be laminated or adhesively secured to the bottom layer only at opposite end portions with the medial portion of said upper layer being left unsecured.. The medial portions of the upper and bottom layers will thus form a pocket for an informational booklet.

BRIEF DESCRIPTION OF THE DRAWINGS

Some of the features and advantages of the invention having been stated, others will become apparent from the detailed description which follows and from the accompanying drawings, in which.

DETAILED DESCRIPTION OF THE PREFERRED EMBODIMENT

Figures 1, 2, 3, 4:
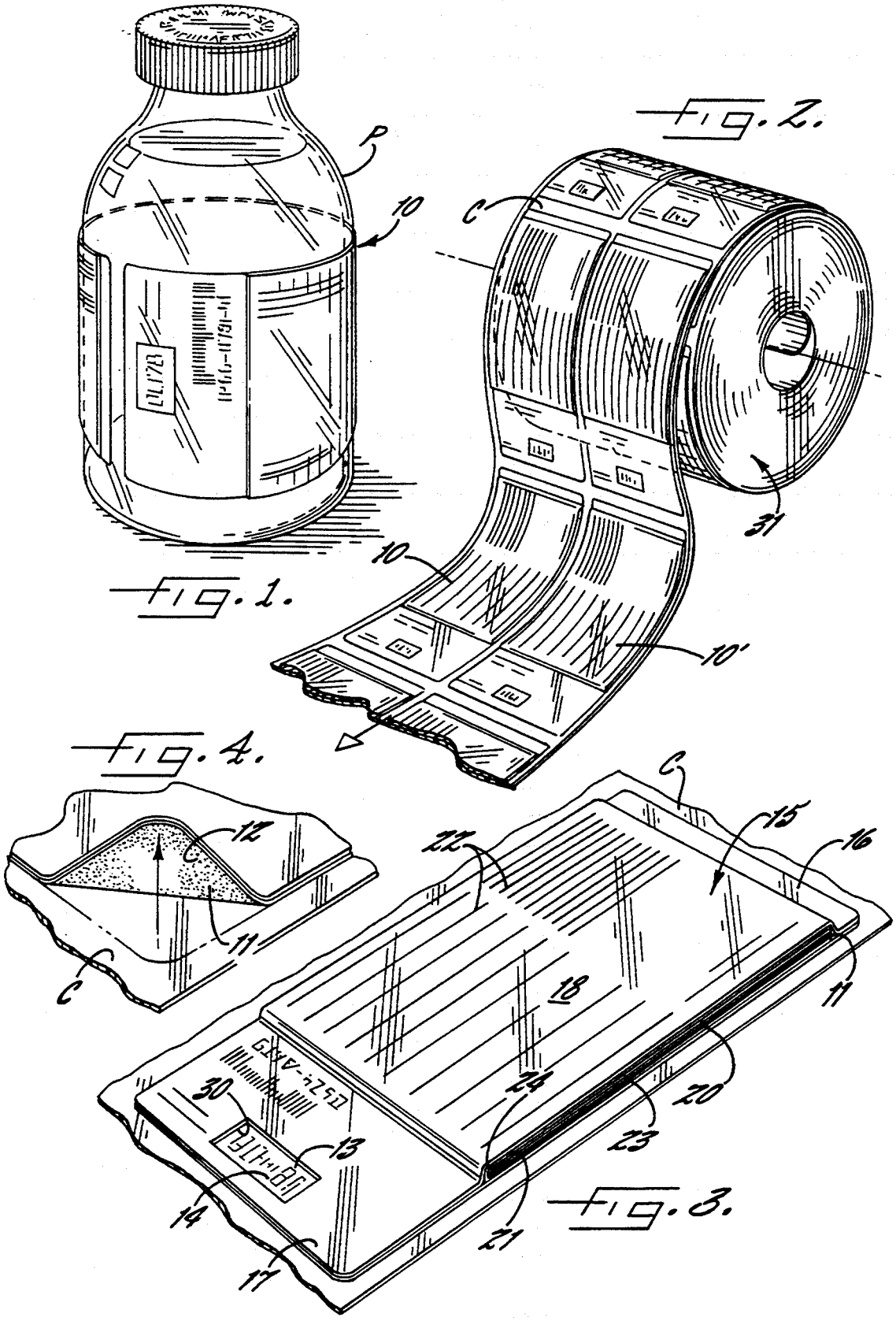
FIG. 1 is a perspective view of a packaged product bearing a label incorporating the features of the present invention.
FIG. 2 is a perspective view of a roll of labels incorporating the features of the present invention.
FIG. 3 is a fragmentary enlarged perspective view of a single label from the roll of labels illustrated in FIG. 2.
FIG. 4 is a fragmentary enlarged perspective view illustrating the removal of an individual label from the carrier web of the roll of labels illustrated in FIG. 2.
Figure 5:
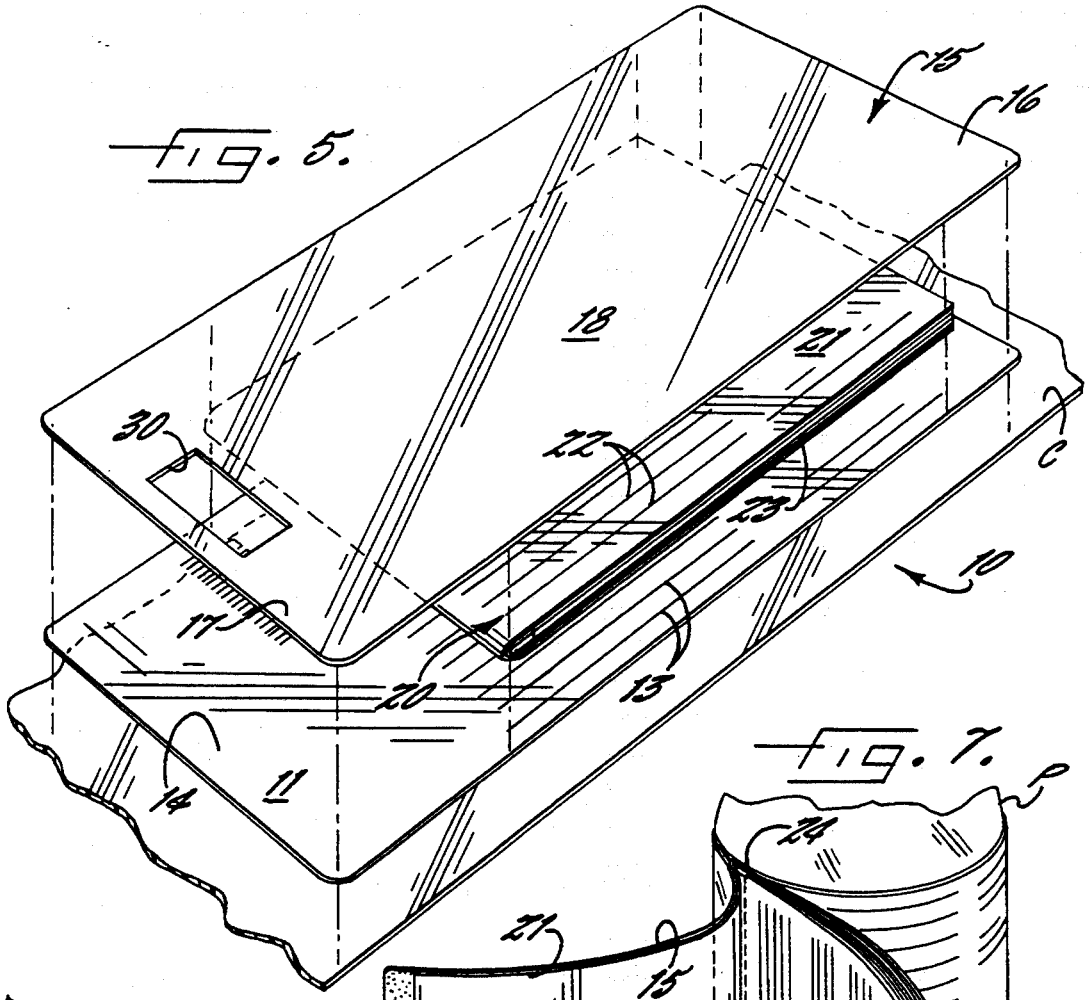
FIG. 5 is an enlarged, exploded perspective view of the label and carrier web illustrated in FIG. 3.

Referring now more specifically to the drawings, there is illustrated in FIG. 1 a packaged product P, such as a pharmaceutical product, which has applied thereto the label of the present invention generally indicated at 10. The label 10 includes a bottom layer 11 having an adhesive coating 12 on the bottom surface thereof and preferably covering the entire bottom surface of the bottom layer 11. The adhesive 12 may be of any desired form sufficient to adhere the label 10 to the packaged product P. A pressure sensitive adhesive is preferred for the adhesive coating 12.

The upper surface of the bottom layer 11 is preferably printed with suitable indicia 13 conveying information about the packaged product P. The bottom layer 11 has an area 14 thereof that is devoid of printed indicia or a printed box or background for purposes to be described hereinafter.

Label 10 further includes a top layer 15 of clear plastic material that is comparable in length and width to the bottom layer 11. Top layer 15 is adhered to bottom layer 11 at least at opposite end portions 16 and 17 thereof. Preferably, the medial portion be of top layer 15 remains unsecured to bottom layer 11 such that the medial portions of the bottom and top layers 11 and 15 define a pocket for an informational booklet 20 to be contained within the label 10.

Informational booklet 20 is preferably multipage including a front cover 21 that has printed indicia 22 thereon containing information about the packaged product P. The informational indicia 22 on the front cover 21 of booklet 20 may be identical to the printed indicia 13 on the bottom layer 11. Booklet 20 includes additional pages 23, which are attached to the front cover 21 and are separable therefrom along a tear line 24 formed of a plurality of spaced apart perforations. Preferably, pages 23 contain printed indicia 25 providing still further information about the packaged product P.

In the embodiment of the present invention which provides for the informational booklet 20, it is preferred that the medial portion 18 of top layer 15 be adhered to the front cover 21 of the informational booklet 20 to prevent the informational booklet 20 from being accidentally dislodged from the label 10. More preferably, the end portion 17 of top layer 15 is secured to the end portion 14 of bottom layer 11 and to the front cover 21 of the informational booklet 20 by a type of adhesive which will not permit ready or easy separation of the end portion 17 and medial portion 18 of the top layer 15 from the bottom layer 11 and the front cover 21 of informational booklet 20. End portion 16 of top layer 15 preferably has a releasable adhesive, such as a pressure sensitive adhesive, which secures end portion 16 of top layer 15 to bottom layer 11 in a releasable manner to permit access to and removal of the pages 23 from informational booklet 20.

If an informational booklet 20 is not to be included in the label 10, the entire top layer 15 may be secured to bottom layer 11 by a type of adhesive not of the releasable type.

There may be applications for such a label without an informational booklet and such an embodiment would be within the scope of the present invention.

In both embodiments, top layer 15 has a die cut window 30 in end portion 17 thereof overlying the unprinted area 14 of bottom layer 11. Window 30 exposes the unprinted area 14 of bottom layer 11 such that additional printed indicia, or a printed box or solid printed area as a background, may be applied to area 14 of bottom layer 11 through the window 30 at or near the time of labeling of the packaged product P.

Figure 9:
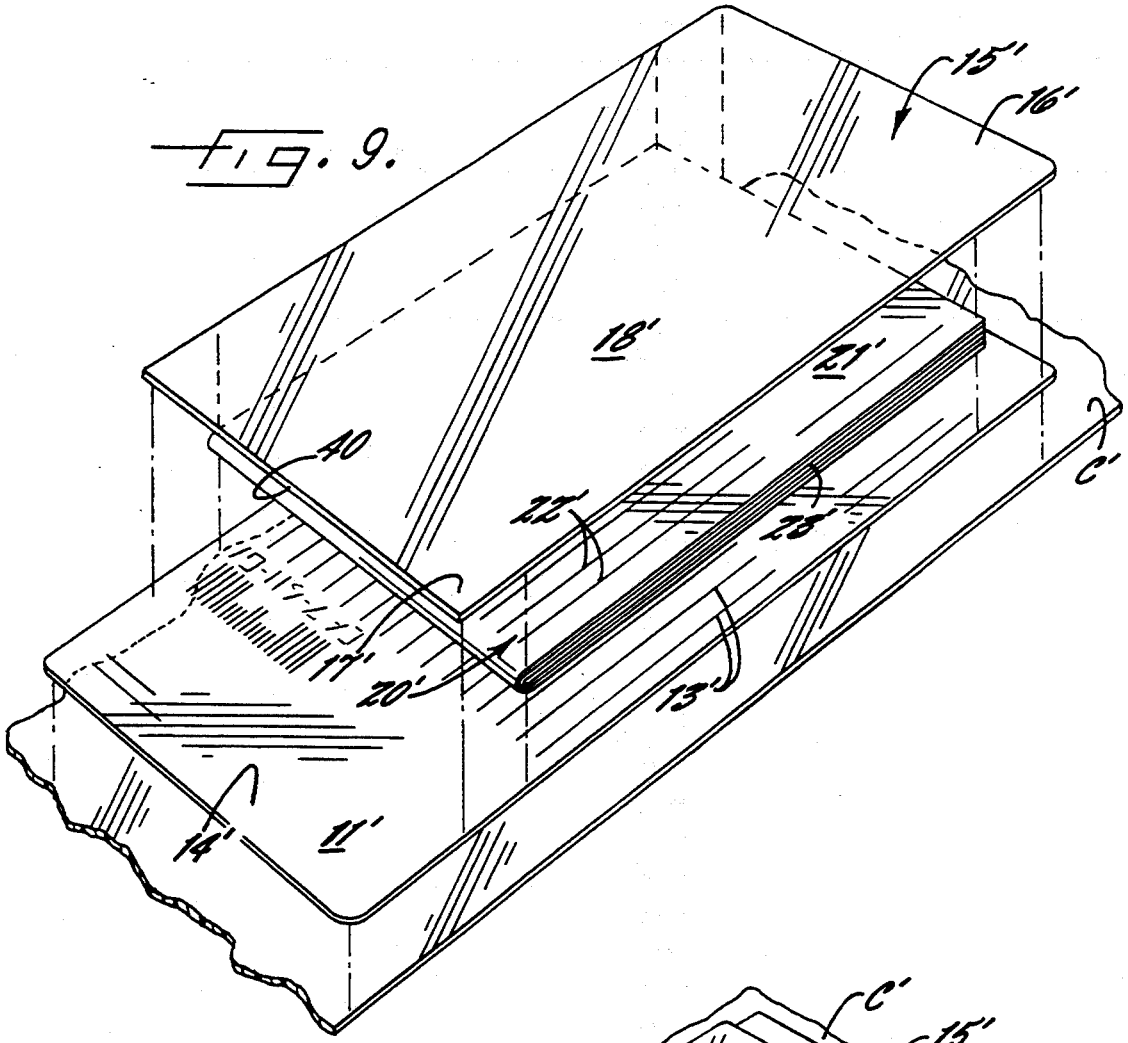
FIG. 9 is an enlarged, exploded perspective view similar to FIG. 5 of another embodiment of the label of the present invention.
Figure 10:
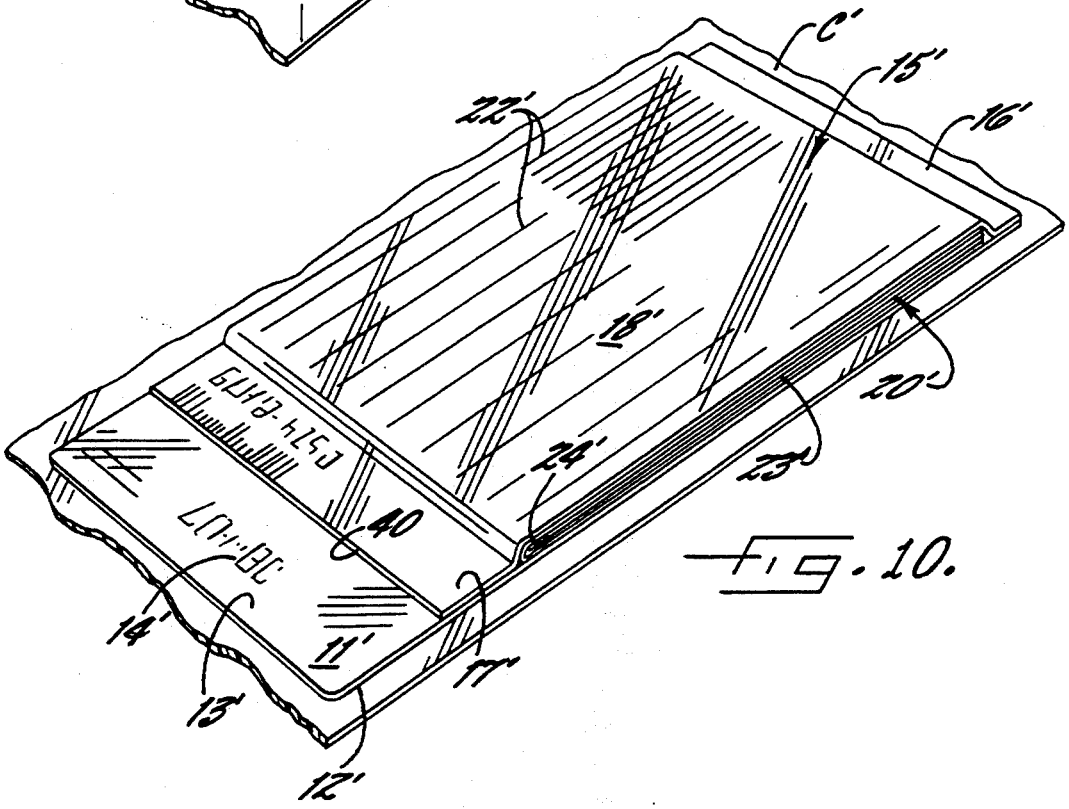
FIG. 10 is a perspective view similar to FIG. 3 of the label illustrated in FIG. 9.

Referring now to FIGS. 9 and 10, there is illustrated another embodiment of the label of the present invention in which like reference characters with the prime notation added are used to indicate similar or like components. Label 10′ is carried by a carrier web C′ and includes a bottom layer 11′ having printed indicia 13′ on the upper surface thereof. Bottom layer 11′ has an end portion 14′ that is at least partially unprinted.

Label 10′ also includes an upper layer having end portions 16′ and 17′ adhesively secured to bottom layer 11′ with medial portion 18′ left unsecured to bottom layer 11′. An informational booklet 20′ is disposed between medial portion 18′ and the bottom layer 11′ and medial portion 18′ is adhesively secured to the front cover 21′ of booklet 20′. Front cover 21′ has printed indicia 22′ thereon, preferably corresponding to the printed indicia 13′ on bottom layer 11′. Booklet 20′ has additional pages 23′ which may or may not be removable from label 10′.

The end portion 17′ of upper layer 15′ has a die cut window formed therein, which in this embodiment removes the entire terminal portion of end portion 17′ along cut edge 40. Accordingly, the terminal portion of end portion 14′ of bottom layer 11′ is thus exposed to receive additional printed indicia or any other matter applied in any way that such matter is conventionally applied to such labels.

The labels 10 and 10′ are formed in accordance with this invention by printing multiple labels or layers for such labels on a web of material. The upper layer web is then die cut to form the windows therein and the layers are secured together. The individual labels 10 or 10′ are then die cut to separate them from the composite webs and are then applied to the carrier web C and C′.

Typically, labels 10, 10′ are supplied to users thereof on the carrier webs C, C′ and labels 10, 10′ are releasably secured to the carrier webs C, C′ by the pressure sensitive adhesive coatings 12, 12′ on the bottom surface of bottom layers 11, 11′. In the form shown in FIG. 2, a roll 31 of labels 10 is illustrated with a pair of labels 10 being secured on the carrier web C in side-by-side relation. Obviously, a single row of labels 10 on a carrier web C could be provided or a plurality of rows of labels 10 greater than two could also be provided on carrier web C.

In use, the user would unroll the labels 10 and carrier web C from the roll 31 and pass the labels through a suitable printing device (not shown) for the printing of additional indicia on the areas 14 of bottom layer 11 through the window 30 in top layer 15 or on the exposed terminal end portion 14′ of bottom layer 11′. Such additional indicia may take any desired form, such as product lot numbers, expiration dates, or any other matter conventionally applied in any manner to such labels. Once the additional indicia is printed on the labels 10, 10′ the same may be removed from the carrier webs C, C′ by peeling the labels 10, 10′ therefrom in the manner shown in FIG. 4. Once removed from the carrier webs C, C′ the individual labels 10, 10′ are applied to the packaged product P. For automatic labeling operations, the labels 10, 10′ may be removed from the carrier webs C, C′ by passing the carrier webs C, C′ and labels 10, 10′ around an abrupt edge in a manner well known to a person skilled in the labeling art.

Figure 6:
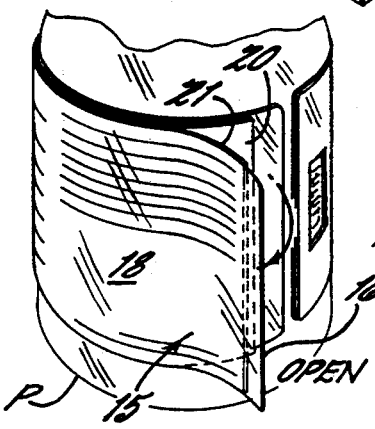
FIG. 6 is a fragmentary perspective view of the packaged product illustrated in FIG. 1 illustrating the manner of removing the top layer of the label to provide access to the informational booklet contained in the label in accordance with the present invention.
Figure 7:
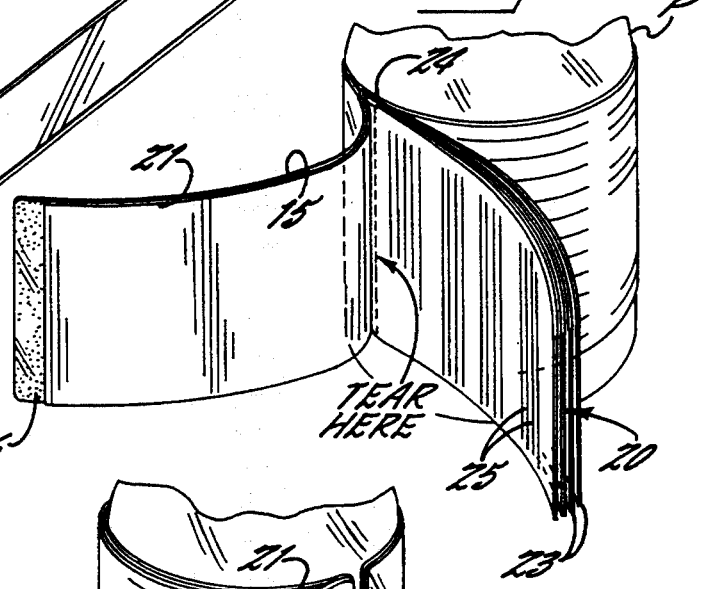
FIG. 7 is a fragmentary perspective view similar to FIG. 6 illustrating the removal of the informational booklet contained within the label of the present invention.
Figure 8:
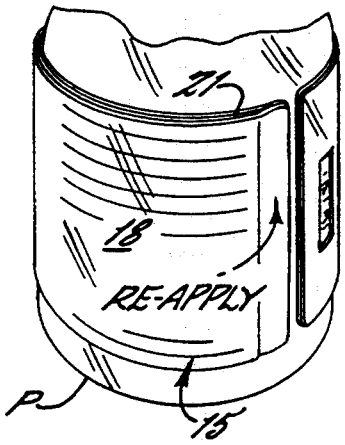
FIG. 8 is a fragmentary perspective view similar to FIGS. 6 and 7 illustrating the reapplication of the top layer of the label of the present invention after the informational booklet has been removed.

After the packaged product P is received by a user or consumer, the consumer can peel the top layer 15, 15′ away from bottom layer 11, 11′ because of the releasable adhesive securing end portion 16, 16′ to bottom layer 11, 11′. Such removal of the top layer 15, 15′ also exposes additional pages 23, 23′ of informational booklet 20, 20′ which may be removed from label 10, 10′ by tearing the same along tear lines 24, 24′. The top layer 15, 15′ and the front cover 21, 21′ of informational booklet 20, 20′ may then be replaced in position and secured to bottom layer 11, 11′ by pressing the same back into contiguous relation with bottom layer 11, 11′, whereby the releasable adhesive on end portion 16, 16′ of upper layer 15, 15′ will again secure upper layer 15, 15′ and front cover 21, 21′ to bottom layer 11, 11′ all as illustrated in FIGS. 6–8.

In the drawings and specifications, there have been set forth preferred embodiments of the invention, and although specific terms are employed, they are used in a generic and descriptive sense only and not for purposes of limitation.

That which is claimed is:

1. A label for use in labeling products, about which information is desired to be imparted to users, comprising a bottom layer of imprintable material of a length and width substantially corresponding to the length and width of said label, said bottom layer having an adhesive coating on at least a portion of the bottom surface thereof to secure the label to a product and having a portion of the upper surface imprinted with suitable indicia concerning the product to be labeled and at least one portion of the upper surface thereof being unprinted, and an upper layer of clear plastic film substantially coextensive with and adhesively laminated to said bottom layer at opposite end portions thereof while being unsecured to said bottom layer in the medial portion thereof to define with the medial portion of said bottom layer a pocket removably receiving and containing an informational booklet about the product to be labeled, said upper layer having a die cut window in one end portion thereof with said upper layer surrounding said window and overlying the unprinted portion of said bottom layer and to expose the unprinted portion of said imprintable bottom layer for the imprinting of suitable additional product information at the time of label application.

2. A label according to claim 1 wherein said adhesive is a pressure sensitive adhesive.

3. A label according to claim 1 wherein said upper layer is laminated to said bottom layer over a greater area at one end portion of said bottom layer than at the other end portion thereof.

4. A label according to claim 2 wherein said upper layer is removably laminated to said bottom layer at the other end of said upper layer to expose the informational booklet positioned in said pocket between said upper and bottom layers.

5. A label according to claim 4 wherein said booklet has multiple pages and wherein all of the pages except the first page have tear lines therein so that said pages are removable from said label.

6. A label for use in labeling packages of products, such as pharmaceuticals, comprising a bottom layer of imprintable material having indicia pre-printed on a portion of one surface thereof with at least one portion thereof remaining unprinted, an adhesive coating covering at least a portion of the other surface of said bottom layer for adhering said label to a package, and an upper layer of clear plastic film laminated to said one surface of said bottom layer at end portions thereof with the medial portion being unsecured and defining a pocket, said upper layer substantially covering said one surface of said bottom layer, said upper layer having a die cut window one of said end portions thereof overlying said unprinted portion of said bottom layer with said upper layer surrounding said window, and said window exposing the unprinted portion of said one surface of said bottom layer therethrough for imprinting additional indicia on said one surface substantially at the time of labeling of the product.

* * * * *

UNITED STATES PATENT AND TRADEMARK OFFICE

CERTIFICATE OF CORRECTION

PATENT NO. : 5,439,721

DATED : August 8, 1995

INVENTOR(S) : John L. Pedroli, et al.

It is certified that error appears in the above-identified patent and that said Letters Patent is hereby corrected as shown below:

Column 2, line 57, after "portion", "be" should be -- 18 --.

Column 3, line 47, after "layer" insert -- 15' --.

IN THE CLAIMS:

Column 6, line 18, after "window" insert -- in --.

Signed and Sealed this

Seventh Day of November, 1995

*Attest:*

*Attesting Officer*

Bruce Lehman

BRUCE LEHMAN

*Commissioner of Patents and Trademarks*